US005144967A

United States Patent [19]

Cartwright et al.

[11] Patent Number: 5,144,967

[45] Date of Patent: Sep. 8, 1992

[54] FLAVOR RELEASE MATERIAL

[75] Inventors: William F. Cartwright, Norcross; Carmen P. DiGrigoli, Canton; Loyd G. Kasbo, Norcross, all of Ga.

[73] Assignee: Kimberly-Clark Corporation, Neenah, Wis.

[21] Appl. No.: 601,160

[22] Filed: Oct. 22, 1990

[51] Int. Cl.[5] ..... A24D 1/02

[52] U.S. Cl. ..... 131/365; 131/335; 162/139

[58] Field of Search ..... 131/365, 369, 358, 359, 131/369, 374, 335, 342, 353, 359; 162/139, 158, 173

[56] References Cited

U.S. PATENT DOCUMENTS 3,369,551 2/1968 Carroll .
3,369,552 2/1968 Carroll .
3,461,879 8/1969 Kirkland .
3,608,560 9/1971 Briskin et al. .
3,738,374 6/1073 Bennett .
3,902,504 9/1975 Owens, Jr. et al. .
3,943,941 3/1976 Boyd et al. .
3,972,335 8/1976 Tiggelbeck et al. ..... 131/342
3,993,082 11/1976 Martin et al. .
4,044,777 8/1977 Boyd et al. .
4,225,636 9/1980 Cline et al. .
4,236,532 12/1980 Schweizer et al. ..... 131/335
4,505,282 3/1985 Cogbill et al. .

FOREIGN PATENT DOCUMENTS 8711735.6 11/1987 European Pat. Off. .

*Primary Examiner*—V. Millin
*Attorney, Agent, or Firm*—William D. Herrick

[57] ABSTRACT

A flavor release material and method for producing the same where the material contains a calculated amount of active surface agent and flavorant adsorbed onto the active surface agent. The flavor release material is capable of controllably releasing flavor and aroma when exposed to a predetermined elevated temperature.

26 Claims, 5 Drawing Sheets

FLAVOR RELEASE MATERIAL

TECHNICAL FIELD

The present invention relates to a flavor release material and method of producing the same. The material is made by combining a fiber portion with a carefully determined amount of active surface agent. The holding capacity of the active surface agent is determined before flavorant is added so as to provide a consistent release of flavorant when exposed to a predetermined elevated temperature.

BACKGROUND OF THE INVENTION

In the cigarette and tobacco industry, there has been considerable development associated with the enhancement of tobacco, cigarette paper, and the production of a new and improved cigarette. To improve the flavor and aroma of a cigar or cigarette, flavorants have been added to the tobacco to enhance or alter the taste and aroma. In addition, tobacco substitutes have been blended with regular tobacco to enhance or alter the taste and aroma.

Briskin et al. (U.S. Pat. No. 3,608,560) discloses a smoking product of oxidized cellulosic material. The filler is made of cellulosic material containing combustible carbon. Martin et al. (U.S. Pat. No. 3,993,082) is a tobacco substitute made with cellulosic fibers and pulverized carbon. Kirkland (U.S. Pat. No. 3,461,879) teaches an oxidized cellulose tobacco substitute. The substitute is made of oxidized cellulose in the form of gauze or pulp that may be blended with other forms of cellulose, polymers or tobacco. Flavoring agents such as menthol, tonka bean, or powdered deer tongue or licorice may be added to the cellulose material.

Other cellulosic tobacco substitutes have been disclosed. Boyd et al. (U.S. Pat. No. 3,943,941) teaches a synthetic smoking product made of combustible flexible fibers and a volatile substance. The flexible fibers contain at least 80% carbon by weight, and the volatile substance may include flavoring agents such as formates, acetates, propionates and butyrates, terpineols or high molecular weight alicyclic alcohols, menthol, vanillin, or tobacco extracts. Boyd et al. (U.S. Pat. No. 4,044,777) is another synthetic smoking product comprised of flexible self-coherent carbonaceous material.

Carroll (U.S. Pat. Nos. 3,369,551 and 3,369,552) teaches a product and process for producing a tobacco substitute. The tobacco substitute is made from leafy plants such as lettuce, cabbage, broccoli, collard, kohlrabi, spinach, and papaya leaves. The product is made by stripping the leafy material of substantially all of its ingredients except the carbohydrates and nitrogen compounds. Flavorants may be added to impart the taste and aroma of tobacco.

Another area of development in the cigarette and tobacco fields is the development of flavored paper. The flavoring agents added to the cigarette paper may also enhance or alter the flavor and aroma of a cigarette or cigar.

Cogbill et al. (U.S. Pat. No. 4,505,282) discloses an inner liner wrap for smoking articles. The inner liner is comprised of combustible porous sheet of cellulosic fibers and finely pulverized porous carbon particles. Flavor materials may be added to the sheet at any point, but are preferably added to the slurry. The flavoring materials include St. John's bread, licorice, glycyrrhizin, ammonium glycyrrhizinate, Clary Sage Oil or Absolute, sclerolide, lupulin, vanillin, menthol, nicotine, and tobacco extracts. Cline et al. (U.S. Pat. No. 4,225,636) teaches a high porosity carbon coated cigarette paper and method for making the same.

Engineered or synthetic cigarettes have also been developed to enhance and improve the flavor and aroma of the cigarette. Bennett (U.S. Pat. No. 3,738,374) discloses a cigar or cigarette having a substitute filler. The cigar or cigarette has a tobacco substitute with a minimal amount of tar. The substitute is made of carbon or graphite fibers, mat, or cloth, associated with an oxidizing agent.

Owens Jr. et al. (U.S. Pat. No. 3,902,504) discloses an engineered cigarette. The invention is a modified cigarette incorporating a tobacco column having a tobacco substitute of shredded carbon filled paper with the tobacco in increasing amounts toward the butt end of the cigarette. These cigarettes are claimed to display a more level yield of constituents in the smoke from tip end to butt end when measured on a puff by puff basis.

Banerjee (European Patent Application 0270916) discloses a smoking article with an improved aerosol forming substrate. The smoking article uses an aluminum capsule within which carbon particles are located. The flavoring agents are adsorbed within the carbon and are emitted when heat is added.

Several problems exist when flavorants are added to tobacco or cigarette paper. Unless a flavorant is fully adsorbed by an active surface agent, such as carbon, the flavorant tends to migrate. When the flavorant migrates, it moves to other areas of the cigarette, such as the paper and filter. In conventional cigarettes, some flavorants such as menthol migrate to all parts of the cigarette. Since menthol will migrate, the carbon fuel source as described in Banerjee is a logical site for the menthol to migrate to, this migration could cause an "off taste." There are applications where it is desirable to lock in the flavor so it does not migrate. There are some advantages to locking in flavorants as some have unwanted odor or need to be unobvious.

The aroma may also be affected by flavorant. With time, flavorants may migrate to the adjacent packaging of the cigarette or cigar. The effectiveness of the flavorant may diminish with continued migration. When the flavorant migrates to the packaging or other areas of the cigarette or cigar, exposure to the atmosphere hastens the diminishing process. A box of cigarettes exposed to ambient air tends to lose its flavor very quickly. Thus, there is a need for complete adsorption of the flavorant onto a medium to eliminate the problems associated with migration.

Another problem arises when flavorants are added to tobacco and smoking articles. In a normal cigarette, added flavorants provide an inconsistent release of additional flavor or aroma as the cigarette is smoked. The first puff has a concentrated amount of flavorant, but as the cigarette is puffed, the flavorant decreases so that the last few puffs contain little or no added flavorant. Thus, there is a need for the controlled and reproducible release of flavorant from a medium when exposed to a known elevated temperature.

SUMMARY OF THE INVENTION

The present invention relates to flavor release material and methods of producing the same. The material is formed with a fiber portion and a specific amount of active surface agent. An active surface agent is defined for the purpose of the invention as a granular material which has been formed or treated so that it has an extremely high internal porosity. Examples of such material are activated carbon, molecular sieves and polymer microsponges. Once the flavor release material is formed, it is then analyzed to determine the content of active surface agent. Based on the content of active surface agent, the amount of flavorant is selected and added to the material. Once the flavorant has been added, samples of the material are tested for flavorant content. The relationship between the amount of active surface agent and flavorant is critical in the effectiveness of the present invention.

It has been found that active surface agents, such as carbon, have the ability to adsorb significant amounts of flavoring agents. Inventors of the present invention have discovered that at a constant known elevated temperature, different results are obtained when varying amounts of flavorant are added at different levels of adsorption to the active surface agent portion of the material. When a small amount of flavorant is adsorbed, there is little or no flavor emitted when exposed to heat, thus the flavor release material is ineffective. When a large amount of flavorant is introduced to the active surface agent, the active surface agent is unable to adsorb it all and there is excess flavorant in the material. The excess flavorant is undesirable in that it is subject to migration and deterioration with time and exposure.

The inventors of the present invention have found that it is desirable to have complete adsorption of the flavorant into the active surface agent. With the active surface agent fully saturated with flavorant, the active surface agent "locks in" the flavorant and it is not released until it is exposed to a known elevated temperature. Furthermore, the flavor release material is able to be released in a controlled reproducible manner. The amount of flavor desired to be released is controlled by the amount of active surface agent added in the material formation process as well as the percentage of flavorant adsorbed in the active surface agent and the elevated temperature to which the material is to be exposed.

In a smoking article, the heat source remains at the tip. A stream of hot air (aerosol) travels the length of the cigarette into the filter. The present invention carefully positions the flavor release material a certain distance from the heat source so that the aerosol temperature is fairly constant. The temperature to which the flavor release material is exposed is an important factor in calculating the amount of active surface agent and flavorant to be added to produce an effective product.

For a given temperature for flavor release, a calculated amount of active surface agent must be added in order to form the material of the invention. Once the material is formed, it is analyzed to verify the actual content of active surface agent. With the content of active surface agent known, the amount of flavorant to add is determined so as to reach but not exceed the adsorption level of the active surface agent. Flavorant is then added to the material in accordance with that determination. Finally, the material is tested for flavorant content to verify the actual amount of flavorant adsorbed in the active surface agent in the material. Both tests for content of active surface agent and flavorant are conducted for the purpose of controlling the addition processes.

Generally described, the present invention may be made by initially using accepted paper making processes in combining a fiber portion with active surface agent. The fiber portion can be made of cellulosic or synthetic materials. The active surface agent may be activated carbons, molecular sieves, polymer microsponges, and other such materials as are known active surface agents. The two ingredients are combined and formed into a sheet. Samples of the sheet are tested for active surface agent content.

Effectiveness of the present invention is highly dependent upon complete adsorption of the flavorant in the active surface agent. Thus it is important to determine the amount of the active surface agent before the addition of flavorant. Furthermore, the controlled reproducible emission of flavorant can be specified based on a given temperature. If the smoking article aerosol temperature is known, then the flavor release material may be manufactured to contain a particular amount of active surface agent and flavorant so as to emit a controlled amount of flavorant in the smoke.

Flavorants in liquid form may be added by printing. Other flavorants are added in vapor form and done by passing the sheet through an atmosphere of vapor. The printing process involves a lower roller having a cellular like surface and an upper rubber roller. A portion of the lower roller is immersed in a vat containing liquid flavorant. As the lower roller rotates, the roller surface contacts one side of the paper as the material moves between the upper and lower rollers. The flavorant is transferred to the material. After the flavorant is added to the paper, the paper is rolled up and wrapped to inhibit the escape of any flavorant until fully adsorbed. Tests are performed on samples of the material with flavorant added to ensure the proper amount of flavorant has been adsorbed in order for the present invention to operate effectively.

The present invention is not limited to application with smoking articles, but may have many other uses. Furthermore, the present invention is not limited to sheets but may be formed into other shapes such as cylindrical rods, pyramids, or cubes.

Thus, it is an object of the present invention to provide a new and improved flavor release material.

It is a further object of the present invention to provide a process for producing a new and improved flavor release material.

It is a further object of the present invention to provide a flavor release material that eliminates the migration of flavorant.

It is a further object of the present invention to provide a new and improved flavor release material where the adsorption of flavorant is precisely characterized so as to provide a controlled emission of flavorant.

It is a further object of the present invention to provide a new and improved flavor release material where the flavorant is determined to be adsorbed into the active surface agent of the material and thus is not susceptible to migration over time or exposure to ambient conditions.

It is a further object of the present invention to provide a new and improved flavor release material that when used in a smoking article provides a controllable composition of flavor and aroma released with each puff.

It is a further object of the present invention to provide a method for producing a new improved flavor release material whereby the active surface agent content is specifically controlled and related to the aerosol temperature.

It is a further object of the present invention to provide a method for producing a new and improved flavor release material whereby the flavorant is specifically determined to be completely adsorbed within the active surface agent so as to eliminate any migration of flavorant over time or exposure to ambient conditions.

Other objects, features, and advantages of the present invention will become apparent upon reading the following detailed description of the embodiments of the invention, when taken in conjunction with the drawings and appended claims.

BRIEF DESCRIPTION OF THE DRAWINGS

The invention will now be described with reference to the accompanying drawing, which illustrates a preferred embodiment of the flavor release material and process for making the same, falling within the scope of the appended claims, and in which:

DETAILED DESCRIPTION OF THE INVENTION

Figure 1:
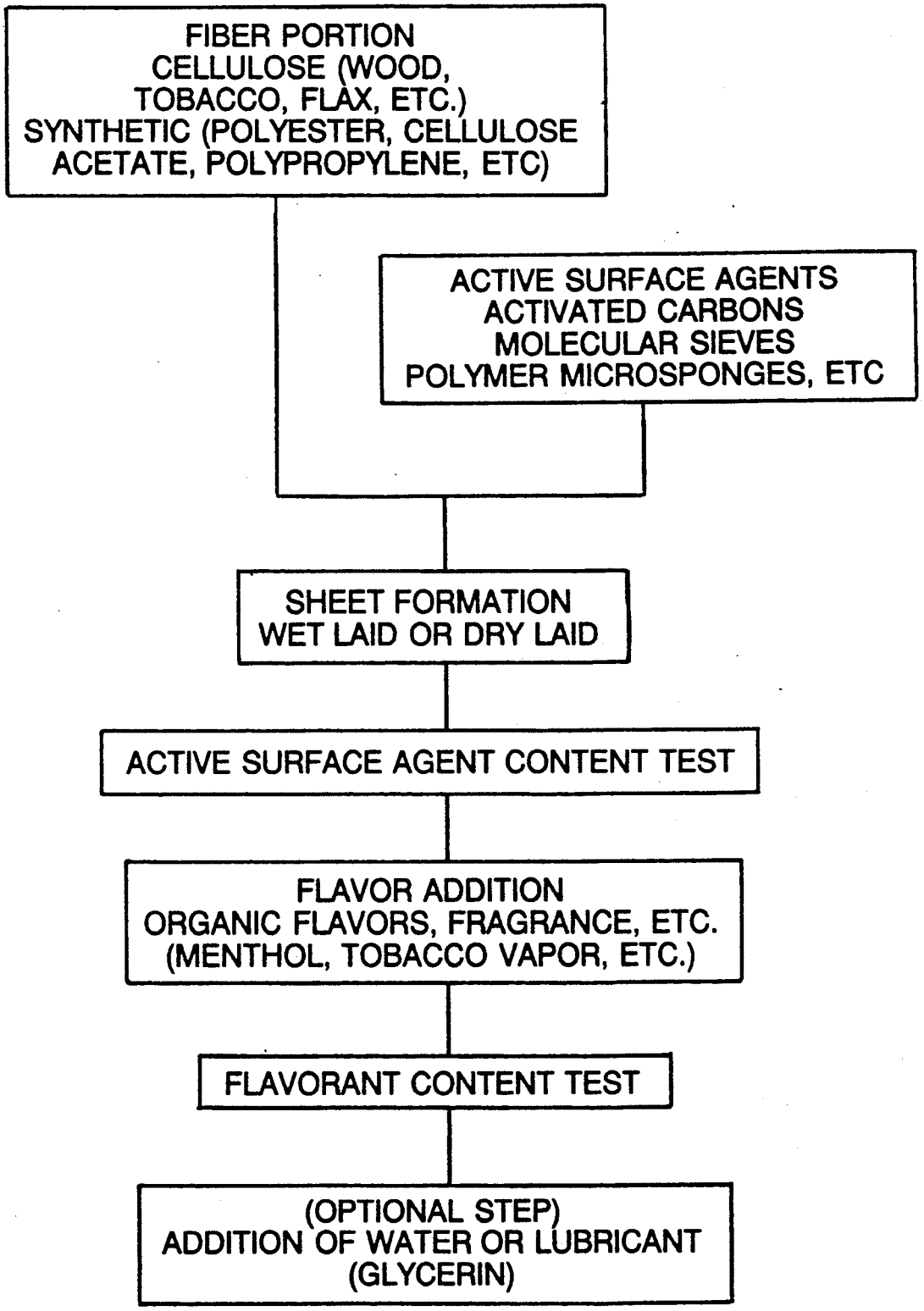
FIG. 1 is a diagrammatic representation of the process of the present invention.

Referring now in more detail to the drawing, which illustrates the general process of the present invention, the first step of the present invention involves combining the fiber portion with active surface agent. The fiber portion of the material may be comprised of cellulosic material such as wood, tobacco, flax, or synthetic material, such as polyester, cellulose acetate, or polypropylene. The active surface agent may include activated carbons, molecular sieves, or polymer microsponges, and other materials as are known active surface agents.

The preferred shape of the present invention is a sheet. The fiber portion and active surface agent portion are mechanically mixed and, using conventional papermaking techniques, a sheet is formed. The two techniques most commonly used in the present invention include wet laid or dry laid sheet formation. The preferred process is a wet laid process.

After the sheet is formed, it is dried with the moisture content carefully monitored. The moisture is controlled by means of a feedback loop which also controls the basis weight or weight per unit area of the sheet. The feedback loop controls the dryer temperature, so if the sheet is measured to have a low moisture content, the feedback loop will automatically lower the temperature of the dryer. The preferred moisture content by weight for sheets made containing tobacco is between 10–16% with 13% being the optimum amount. For sheets made entirely of wood, the moisture content range is 4–7% with the optimum ambient being 5% by weight. It has been found that material made with tobacco having a moisture content that exceeds 16% by weight is prone to mold. Material having less than 10% water by weight is considered too brittle to undergo processing.

After drying, the sheet is then tested for the content of active surface agent. Active surface agent content is important in the effective operation of the present invention. The amount of active surface agent may vary between 0.1–40% by weight, with the preferred range being 15–35%. The amount of active surface agent added depends on the desired amount of flavorant to be emitted for a given set of conditions. The conditions include adsorption level, temperature and the type of flavorant added. For example, it has been found that a smoking article having 17% carbon by weight fully saturated with menthol emits 450 micrograms of menthol at a temperature of 150° C. Thus, the amount of active surface agent in the sheet must be known in order to determine the proper adsorption of flavorants in the active surface agent.

The preferred active surface agent is carbon. The test to determine the carbon content in the paper is to test the adsorption of carbon tetrachloride ($CCl_4$). The same test may be used in determining the content of molecular sieves and, in theory, molecular sponges, or any other known active surface agent.

Figure 2:
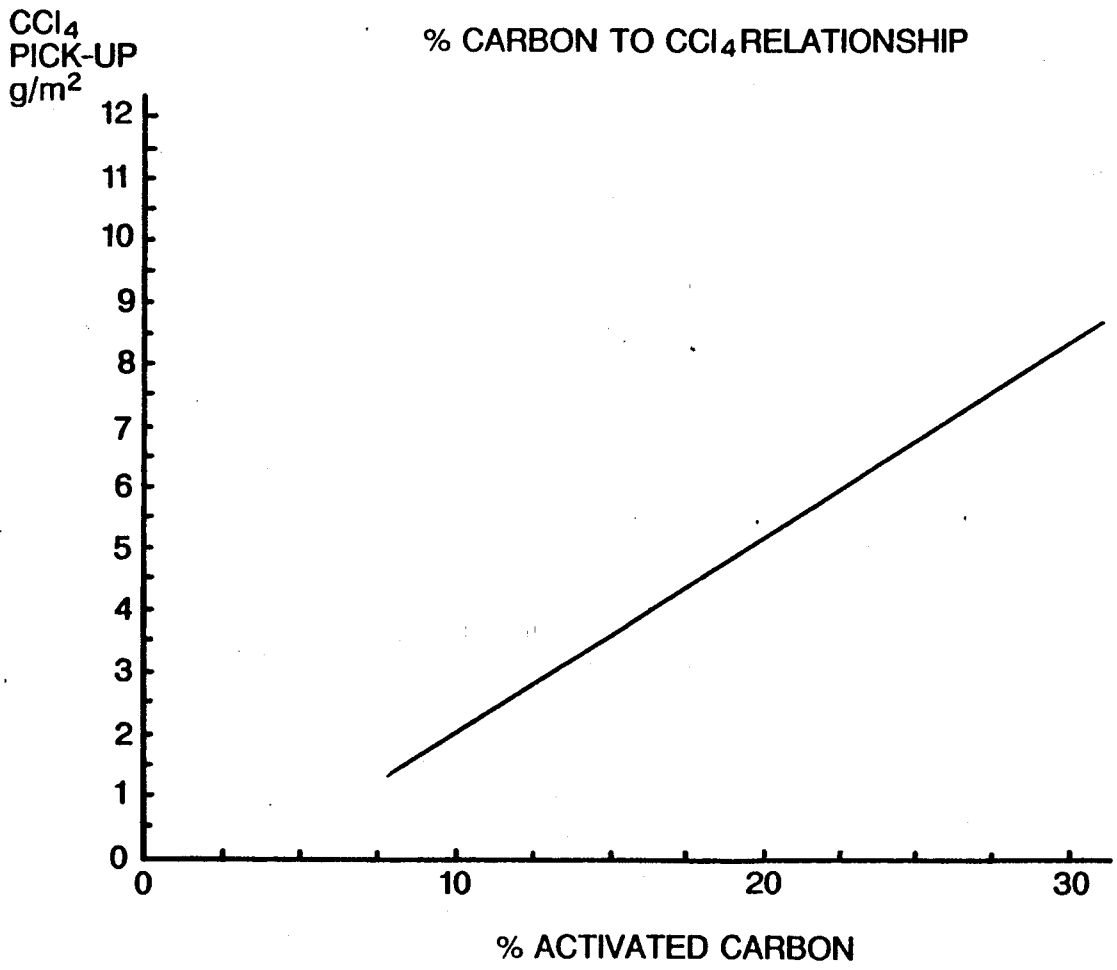
FIG. 2 is a graph showing the relationship of the carbon tetrachloride pickup in grams per square meter to the percent activated carbon in a paper sheet.

The amount of carbon in the flavor release material can easily be determined by determining the amount of carbon tetrachloride adsorbed in the carbon. This relationship between the carbon tetrachloride adsorption in grams per square meter and the percent of a specific activated carbon in the sheet is shown in FIG. 2. Samples measuring 10 cm wide by 25 cm long are used for the test. The test is carried out in a controlled environment chamber held at 50% relative humidity and 22° C. The samples are suspended on a balance hook extending from a Sartorius balance, or the equivalent, having a bottom loading capability and 0.001 gram accuracy up to at least 10 grams. The samples must be allowed to equilibriate in ambient air for ten minutes. The samples are then weighted and recorded. Within a balance enclosure, the samples are then exposed to an excess of carbon tetrachloride ($CCl_4$) placed in a 1000 milliliter resin kettle. The samples should be exposed to carbon tetrachloride ($CCl_4$) vapor for ten minutes. The samples should then be weighed and recorded. The amount of carbon tetrachloride pickup as a basis weight may be calculated using the following equation:

$$BW_{CT} = CCl_4\text{pickup, g/m}^2 = 40 \times (W_f - W_i)$$

Where:

$W_f$ = final sample weight (after exposure), grams.

$W_i$ = initial sample weight, grams.

After the amount of active surface agent is determined, flavorant is added to the sheet. The amount to be added is determined by the amount of active surface agent in the material, its holding capacity for the specific flavorant to be used, and the desired level of adsorption. Flavorants include flavors and fragrances such as menthol, and tobacco vapor.

The preferred method used in adding the flavor for flavorants in liquid form is a rotogravure technique. The procedure involves a lower and upper roller between which the sheet passes. The surface of the lower roller contains cells preferably quadrilaterally shaped where the ends are angled outward. The cells help to transfer the liquid flavorant to the sheet. A portion of the lower roller is immersed in the liquid flavorant so that the cells adsorb the liquid flavorant. The preferred flavorant is menthol. In the present method, the menthol is in molten form. As the lower roller rotates, the cells transfer the liquid to the lower surface of the paper. The upper roller is comprised of rubber or a similar substance and controls the feeding process.

The surface of the paper is important in the transfer of flavorant. In carbon paper there is a carbon rich side and a carbon poor side. Transferring flavorant to the carbon poor side results in a better transfer due to the smoothness of the surface which enables the roller to obtain better contact. Parameters of transfer of flavorants that are well known to the art must be considered (such as flavorant viscosity and surface tension) when using this process. Additional factors that influence the flavorant transfer are the line speed, and the cell size and shape, and the pressure between the rollers.

After the flavorant is added to the sheet, additional water or lubricant such as glycerin may be added to the sheet to ensure that the material has the desired moisture content. If the sheet becomes too dry, it will become brittle and difficult to handle.

After the flavorant has been added, samples of the sheet are tested to determine the actual flavorant content. The test to determine flavorant content is a gas chromatography test wherein solutions containing a known amount of flavorant are compared by means of gas chromatography with the test samples to determine the amount of flavorant in the test samples.

A gas chromatograph is used to separate the menthol or other flavorant used from other extract components and to measure its concentration. The gas chromatograph is calibrated with a standard solution having a known menthol concentration. Comparison of gas chromatograph results from the extract with the standard are used to determine the menthol concentration of the extract. The menthol content of the sheet is then calculated from the menthol concentration and expressed in grams per square meter.

The gas chromatograph is calibrated with known standards containing precise amounts of menthol. Samples of the material to be tested are of standard dimensions, the samples being cut from the center of the material. The samples are preferably cut along the width of the sheet, also known as the cross direction. From a stack of ten samples, one sample is removed from the middle of the stack, folded and placed in an Erlenmeyer flask that has been preloaded with fresh isopropyl alcohol. For example, 20 milliliters of isopropyl alcohol is used with 3.35 square inches of sheet.

The sample is placed on a shaker for three hours at preferably 250 rpms to extract the methol. After three hours, a disposable syringe is used to remove one milliliter of solution from the flask and injected into a gas chromatograph vial. Another syringe is used to inject one milliliter of the menthol standard into a gas chromatograph vial. Comparison of the sample with the known menthol concentration is then run on the gas chromatograph and the results recorded.

The results from the gas chromatography test serve to confirm the menthol content in the flavor release material. If the carbon content in the material is at the specified level, and the flavorant is completely adsorbed in the carbon, then the amount of flavorant actually adsorbed should equal the amount specified. If it is found that the amount of flavorant is below or above the amount specified, the sheet is discarded and the process of impregnating flavorant is repeated using a new sheet already tested for carbon content.

If the flavorant content measured is at the specified level, the sheet is stored for later use. The sheet is stored by rolling it up and wrapping it in aluminum foil. The aluminum foil helps to eliminate migration of the flavorant before it is completely adsorbed in the active surface agent.

Figure 3:
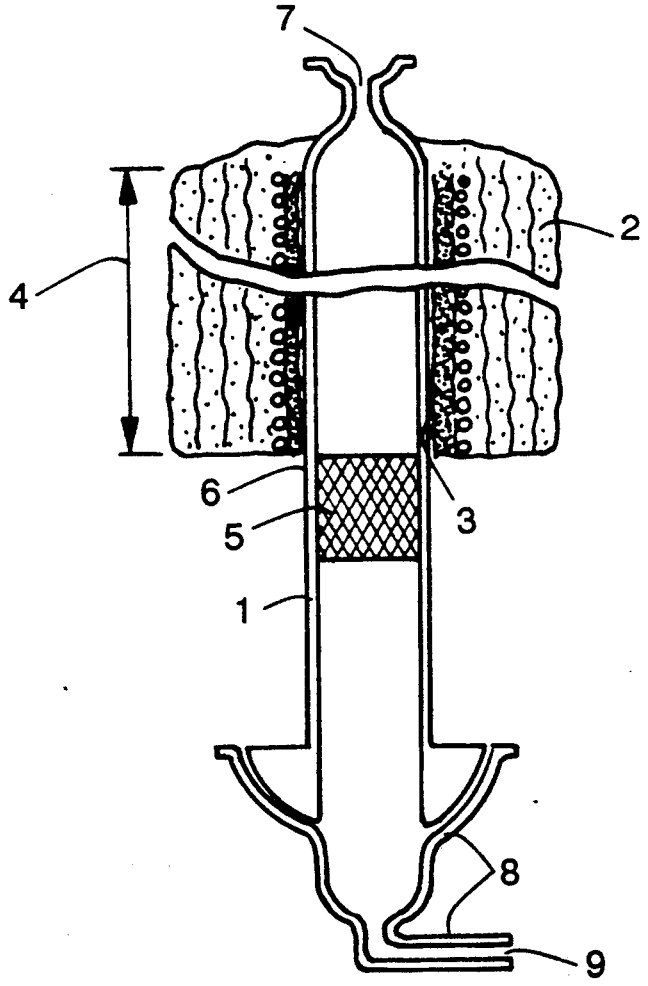
FIG. 3 is an illustration of a device used to measure flavor release from the flavor release material in accordance with the invention.

To demonstrate the flavor release properties of the material of the present invention, the test apparatus shown in FIG. 3 has been found to be useful.

The apparatus shown in FIG. 3 may be termed a "plug desorber" and is comprised of a column of glass tubing (1) with an inside diameter of approximately 7 mm surrounded by a furnace (2) whose temperature can be carefully maintained with a temperature controller (not shown). The temperature is measured with a thermocouple (3), and the furnace extends ten inches (4) above the position of the test sample (5). The test sample plug (5) is placed in the apparatus at the exact, same position each time by use of a fiducial mark (6). An air/nitrogen inlet (7) provides the gas for heating the sample (5). The bottom of the column (1) is heated and insulated (8), and the exit aerosol (9), composed of air or nitrogen plus flavorant, is pulled through a gas chromatograph (not shown) with a Borgwaldt smoking machine (not shown), for analysis of the flavor content. The use of the Borgwaldt smoking machine allows the samples to be tested under different smoking conditions. A typical set of puffing conditions used was a 35 milliliter puff with a two-second duration and a repetition puff every 30 seconds. The gas temperature at the sample location was typically or normally set at 150° Centigrade.

Figure 4:
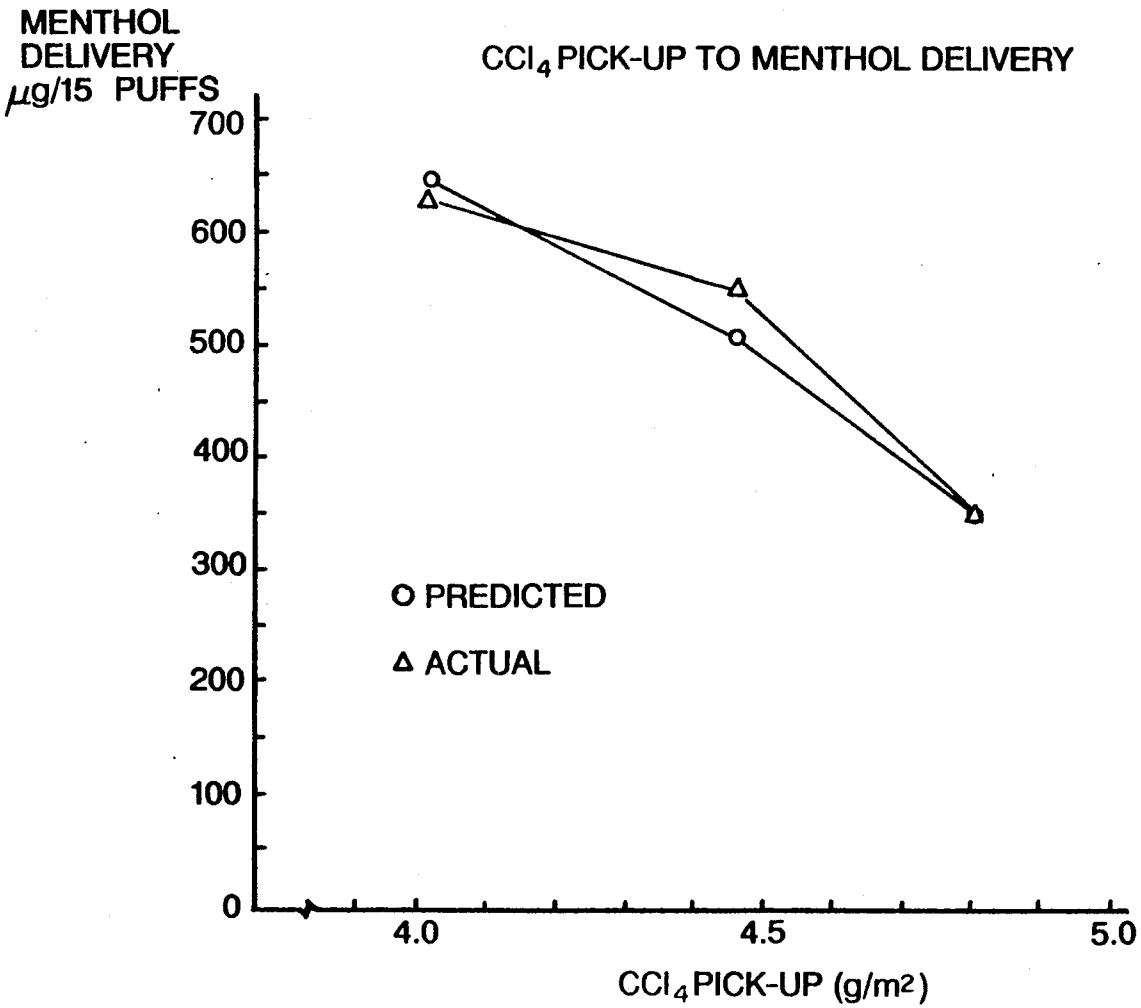
FIG. 4 is a graph showing that the amount of menthol release at specified conditions can be predicted by a carbon tetrachloride pickup in the sheet material.

Using the plug desorber, it was shown that for a given set of conditions one could predict the flavor delivery knowing the carbon tetrachloride pickup in the flavor release material. This relationship is shown in FIG. 4.

Figure 5:
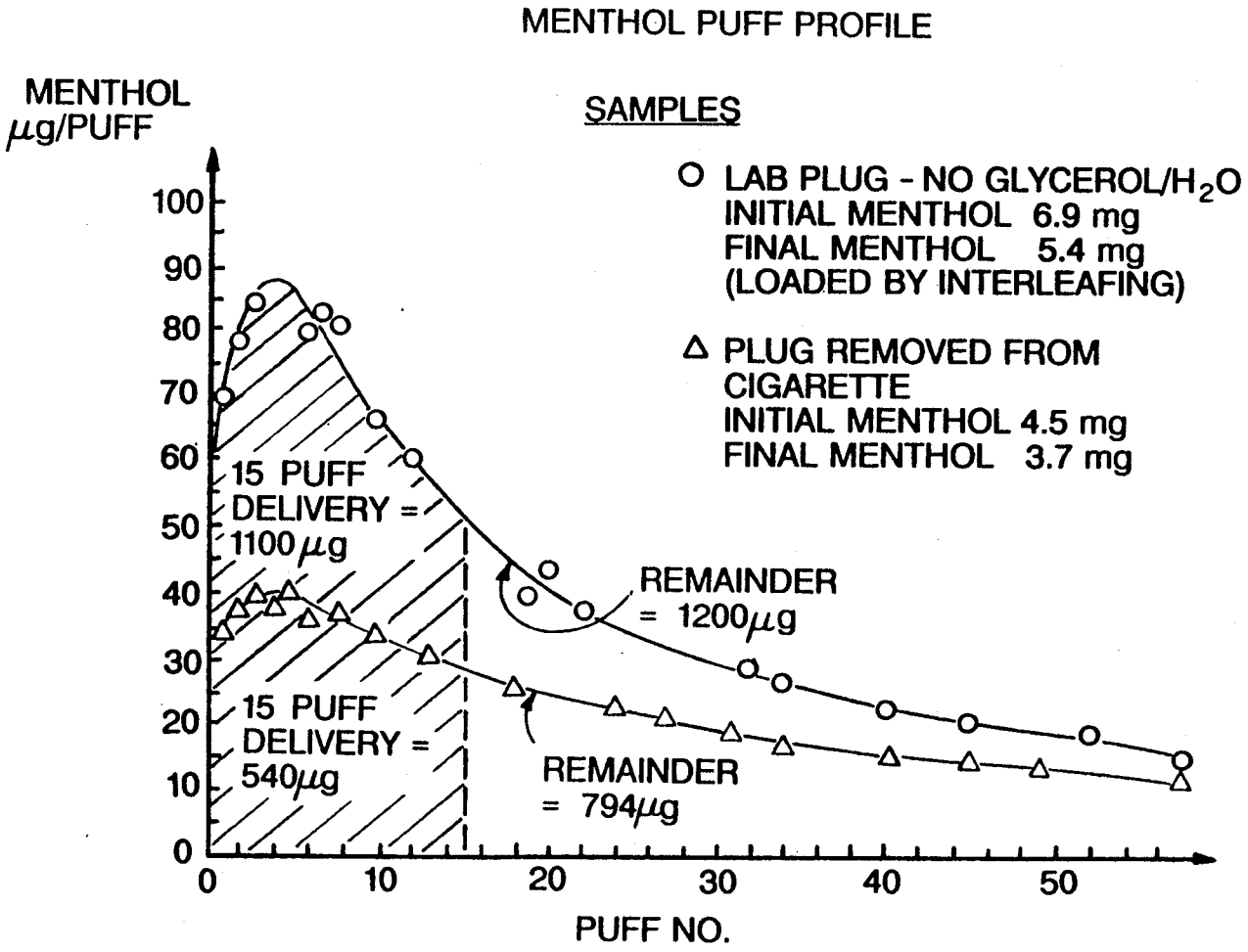
FIG. 5 is a profile of the menthol release from the flavor release material, formed into a plug, and placed in a simulated cigarette structure.

With the plug desorber, it is possible to determine the delivery on a puff by puff basis of a flavorant; e.g., menthol that would be delivered to a cigarette user under typical smoking conditions. FIG. 5 shows the menthol delivery profile for two different flavor release materials. This enables a cigarette producer to know how much flavor the cigarette user will receive without going through costly production runs and extensive testing of cigarettes.

The following examples are provided in order to further illustrate various embodiments of the invention but should not be construed as limiting the scope thereof.

EXAMPLE 1

A 40.7 g/m$^2$ sheet is made on a paper machine containing cellulose fibers and a surface active carbon. A carbon tetrachloride adsorption number is run on the paper sample obtaining a value of 5.9 g/m$^2$. Since it is known by experimentation that the sample of activated carbon used to make the paper will adsorb 63% of its weight of $CCl_4$, the above measured $CCl_4$ number shows that the paper contains 23% activated carbon. Knowing that this amount of activated carbon is in the sheet, it would take an application of 3.5 g/m$^2$ of menthol to fully saturate the activated carbon in the paper. After the carbon has adsorbed the methol, the sheet has little or no odor of menthol at ambient conditions but, when raised to an elevated temperature, the paper will give off a constant odor or taste of menthol.

EXAMPLE 2

A 40.2 g/m$^2$ sheet is made of a paper machine containing cellulose fibers and a surface active carbon. A value of 4.3 g/m$^2$ was obtained for the carbon tetrachloride adsorption number. This sheet contained 17% activated carbon. In order to fully saturate the sheet with menthol, 2.6 g/m$^2$ of menthol is needed to be applied to the sheet. For this sheet, a second flavorant, peppermint, was used to produce the final finished sheet. The menthol was coated on first with a rotogravure roll to put on 2.4 g/m$^2$. Analytical results from the gas chromatograph confirmed the correct level of menthol in the paper sheet. The roll of material was wrapped and allowed to set until all the menthol was adsorbed by the activated carbon. The roll was retreated a second time with an aqueous solution of peppermint and glycerin. Analytical results confirmed that 0.10 to 0.13 g/m$^2$ peppermint and 1.5 g/m$^2$ of glycerin were printed on the sheet. Follow-up smoking panel tests on cigarettes containing the above treated paper as a plug in the mouth end piece confirmed the taste of both menthol and peppermint. The flavor impression was considered to be reasonably uniform over the smoking of the cigarette.

It will be appreciated that the embodiments discussed above are preferred embodiments, falling within the scope of the appended claims, and that various alternative embodiments are contemplated. For example, the flavor release material may be formed in shapes other than a sheet. Furthermore, positional adjectives such as lower and upper are used only to provide an understanding of the interrelationship of various parts of the invention. Other orientations of the invention can be contemplated.

We claim:

1. A method of manufacturing a flavor release material comprising the steps of:

providing a fiber material having a moisture content selected to avoid mold formation or brittleness;

combining said fiber material with an active surface agent;

forming the material into a desired shape;

testing samples of the material for content of the active surface agent;

adjusting the level of active surface agent as necessary to maintain a content in the range of 0.1 to 40 percent by weight;

adding flavorant to the material;

testing samples of the material for the amount of flavorant added; and adjusting the amount of flavorant added to maintain the level at or below the amount necessary to saturate the active surface agent present.

2. The method of claim 1 wherein the fiber material comprises cellulosic or synthetic material.

3. The method of claim 1 wherein the shape is a sheet.

4. The method of claim 1 wherein the active surface agent is selected from the group consisting of activated carbons, molecular sieves, and polymer microsponges.

5. The method of claim 3 wherein the formation of the sheet is by a wet laid process.

6. The method of claim 3 wherein the formation of the sheet is by a dry laid process.

7. The method of claim 1 wherein the active surface agent content is measured by the amount of adsorption of carbon tetrachloride ($CCl_4$).

8. The method of claim 1 wherein the flavorant comprises menthol, tobacco vapor, or other fragrances and flavors.

9. The method of claim 1 wherein the flavorant is added by means of a rotogravure printing procedure.

10. The method of claim 1 wherein the flavorant content is determined by gas chromatography.

11. A flavor release material manufactured in accordance with the method of claim 1.

12. A flavor release material manufactured in accordance with the method of claim 2.

13. A flavor release material manufactured in accordance with the method of claim 3.

14. A flavor release material manufactured in accordance with the method of claim 4.

15. A flavor release material manufactured in accordance with the method of claim 7.

16. A flavor release material manufactured in accordance with the method of claim 8.

17. A flavor release material manufactured in accordance with the method of claim 9.

18. A flavor release material manufactured in accordance with the method of claim 10.

19. A flavor release material comprised of fiber, active surface agent, and flavorant adsorbed in the active surface agent wherein the amount of the active surface agent is determined, the flavorant is then added, and the amount of flavorant actually adsorbed is determined whereby flavorant is maintained at or below the amount necessary to saturate the active surface agent present and is controllably emitted from the material upon exposure to a constant predetermined elevated temperature.

20. The material of claim 19 wherein the fiber comprises cellulosic or synthetic material.

21. The material of claim 19 wherein the active surface agent is selected from the group consisting of activated carbons, molecular sieves, and polymer microsponges.

22. The material of claim 19 wherein the flavorant is menthol, tobacco vapor, or other fragrances and flavors.

23. The material of claim 19 wherein the amount of active surface agent is determined by the amount of adsorption of carbon tetrachloride ($CCl_4$).

24. The material of claim 19 wherein the flavorant is added by means of a rota gravure printing procedure.

25. The material of claim 19 wherein the amount of flavorant actually adsorbed is determined by means of gas chromatography.

26. The material of claim 19 wherein the active surface agent is in the range of 0.1–40% by weight.

* * * * *